United States Patent [19]

Sauzay

[11] 4,427,217

[45] Jan. 24, 1984

[54] SKI ASSEMBLY WITH CARRIER

[76] Inventor: Bertrand Sauzay, 25 quai Tilsitt, Lyon (Rhone), France

[21] Appl. No.: 278,428

[22] Filed: Jun. 29, 1981

[30] Foreign Application Priority Data

Jul. 4, 1980 [FR] France ..... 80 15316

[51] Int. Cl.[3] ..... A63C 11/02

[52] U.S. Cl. ..... 280/814

[58] Field of Search ..... 280/814, 815, 816, 224, 280/294, 809, 605, 606; 224/917; 294/147; 16/125, 126, DIG. 24, DIG. 25

[56] References Cited

U.S. PATENT DOCUMENTS

| | | | |
|---|---|---|---|
| 1,875,121 | 8/1932 | Olson | 16/125 |
| 3,259,086 | 7/1966 | Stein | 16/126 |
| 3,780,920 | 12/1973 | Green | 294/147 |
| 4,018,455 | 4/1977 | Bieler | 280/605 |
| 4,190,182 | 2/1980 | Hickey | 224/45 S |

FOREIGN PATENT DOCUMENTS

| | | | |
|---|---|---|---|
| 2307807 | 8/1974 | Fed. Rep. of Germany . | |
| 2535224 | 2/1977 | Fed. Rep. of Germany . | |
| 2647201 | 10/1977 | Fed. Rep. of Germany . | |
| 2726701 | 12/1978 | Fed. Rep. of Germany | 280/605 |
| 2162448 | 7/1973 | France . | |
| 2285910 | 4/1976 | France . | |
| 2416026 | 8/1979 | France . | |

*Primary Examiner*—David M. Mitchell
*Assistant Examiner*—Joseph McCarthy
*Attorney, Agent, or Firm*—Karl F. Ross; Herbert Dubno

[57] ABSTRACT

A carrier for a pair of skis comprises on each ski, in the region of the center of gravity of the ski assembly (i.e. the combination of ski and binding) a stirrup-shaped or bail-shaped handle which is movable between a retracted position in which the handle overlies the upper surface of the ski in the region of the center of gravity of the assembly and below the ski boot, and a position in which the handle extends outwardly beyond a longitudinal edge of the ski. A pair of skis can be carried in a balanced manner by gripping both handles thereof although the device also enables balanced carrying of a single ski.

8 Claims, 12 Drawing Figures

FIG. 9
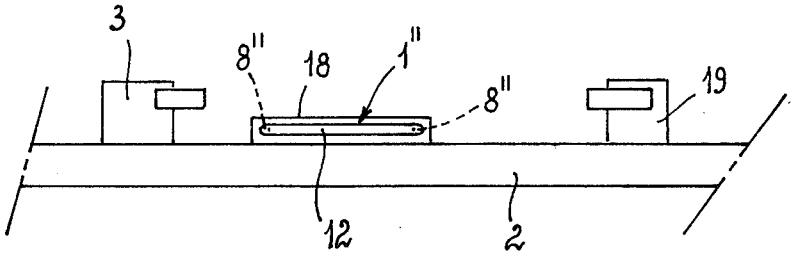
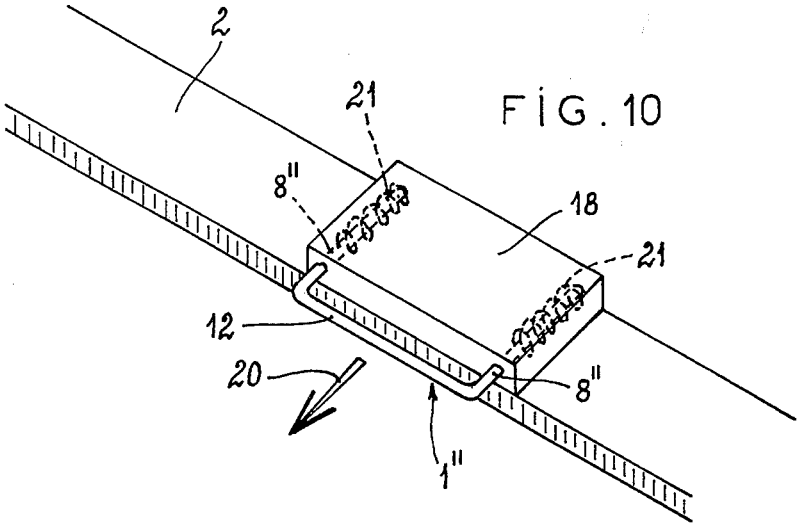
FIG. 10
FIG. 11
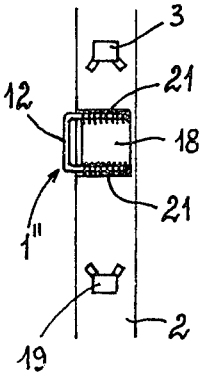
FIG. 12
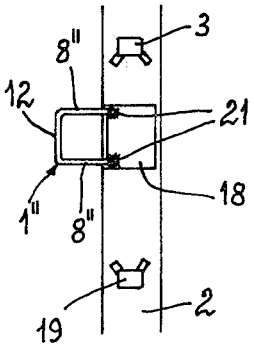

SKI ASSEMBLY WITH CARRIER

FIELD OF THE INVENTION

My present invention relates to a ski assembly and carrier and, more particularly, to a carrier for skis which enables the balanced carrying in one hand of a pair of skis or an individual ski.

BACKGROUND OF THE INVENTION

A ski assembly, for the purposes of this description, will be understood to comprise a ski, the usual binding mounted on the ski and adapted to engage the ski boot of the skier, e.g. via a toe piece or clamp and a heel-engaging member, and any ancillary device which may be required for convenience of safety purposes and which is more or less permanently mounted on the ski, e.g. a ski brake or tether preventing loss of the ski should the same become detached from the ski boot.

The transport of skis generally poses a problem when the skis must be carried any significant distance because the length of a ski makes it unwiedly although a ski assembly is not particularly heavy. The manual transport of skis is commonplace under many circumstances, e.g. travel to the slope, upon leaving a ski trail, return from the slope or trail, during rest periods and the like.

A problem appears to reside in the fact that there is no place to grip a ski effectively which will allow balanced transport in a convenient manner.

This is not to say that devices have not been proposed to facilitate the transportation and carrying of skis.

For example, it is known to provide a device having a handle and a pair of belts which can be locked around a pair of skis placed in bottom-to-bottom contact, thereby enabling the pair of skis to be carried conveniently.

However, the strapping of the skis together is a time consuming process and the use of the device requires that it always be carried by the skier and must be stored on the person when it is not in use. Furthermore, the device is difficult to use because it requires that the skier first determine the location of the center of gravity of the pair of skis.

Furthermore, this device cannot be used for the transport of a single ski and hence cannot be employed when a single ski must be taken to the shop for repair or adjustment of the bindings, for replacement or for other treatment, e.g. waxing or refinishing.

In more general terms it may be said that systems for the transportation of skis generally do not allow for the transport of a single ski although this is of great importance. For example, a child may not be able to carry a pair of skis in one hand and hence conventional ski transporters are unsuitable. Adults frequently desire to carry a single ski for the reasons already mentioned and hence a ski transporter capable of single ski manipulation is thus highly desirable.

OBJECTS OF THE INVENTION

It is the principal object of the present invention to provide an improved ski-carrying device whereby the disadvantages of earlier systems are obviated.

Another object of this invention is to provide a device which is simple and of light weight and which facilitates the carrying of a pair of skis or of a single ski in a balanced manner.

Yet another object of this invention is to provide a device for the purposes described which can be operated by any skier, adult or child, in a simple and convenient manner and which eliminates the need to carry around the device on the person of the skier when it is not in use for ski transport.

SUMMARY OF THE INVENTION

These objects and others which will become apparent hereinafter are obtained in accordance with the present invention in a device for carrying a pair of skis each forming a ski assembly, as this term has been defined previously, which comprises a handle secured to each ski close to the center of gravity of the assembly (i.e. the combination of ski and binding), between the front and rear members of the ski binding, so as to be displaceable between a retracted position in which this handle lies beneath the ski boot of the skier when the handle is not in use and an extended position wherein said handle projects outwardly of or beyond a longitudinal edge or side of the ski so as to enable the handle to be gripped and the ski to be transported in a balanced manner either individually or, in one hand, as a pair of skis both of whose handles are gripped in the same handle.

Thus the ski-carrying devices of the invention are permanently mounted at the center of gravity, are readily shifted between the two positions and thus simply and conveniently permit balanced carrying of one ski or a pair of skis together.

According to the embodiment of the invention, the device comprises, for each ski, a handle in the form of a stirrup which is swingably mounted on the ski and advantageously along a longitudinal edge thereof, so that the shanks of the handle are disposed equidistantly on opposite sides of the center of gravity of the ski, the pivot axis being parallel to the longitudinal direction of the ski. This handle is adapted to pivot through about 180° about its pivot axis between its retracted position in which the handle shanks and bight overlie the upper surface of the ski and the extended position in which the handle projects outwardly from this side or edge of the ski.

When the skis are used for normal skiing maneuvers, each handle in its retracted position lies beneath a ski boot of the skier.

It has been found to be advantageous, moreover, to provide the two shanks of the stirrup, as bent arms, whose free ends are further bent and form pintles in respective hinge members fixed on the aforementioned side or edge of the ski.

The bent shanks thus overhang this edge of the ski in the retracted position and, in the extended position, the plane of the stirrup can be offset from the hinge axis, thereby allowing a pair of skis in a bottom-to-bottom juxtaposition to be carried with the two stirrups held in one hand of the user.

When two skis are carried in this manner, similar to the carrying of a valise, the skis temselves are suspended in a mutually parallel balanced manner from the respective handles.

The skis can be transported in a substantially horizontal orientation without any tendency of an end of the ski to be canted upwardly because of an offset between the center of gravity and the supported locations in the longitudinal direction, the center of gravity being straddled by the shanks of the handle.

Naturally, the handle and its mounting structure can form part of the ski binding or of other elements or accessories commonly mounted on the ski.

According to a second embodiment of the invention, the handle is slidably mounted on the ski so as to shift in a plane parallel to the plane of the ski and in a direction perpendicular to the longitudinal axis of the ski in the region of the center of gravity of the assembly.

To this end, a guide plate is mounted on the surface of the ski and a handle is retractively associated therewith. When the handle is not used for ski transport, a spring or the like can retract the handle into the plate which can form a tread plate below the ski boot. When the handle is withdrawn from the plate, however, one or two skis can be carried in the manner described above. The guide plate thus can be disposed between the tow- and heel-engaging member of the binding.

Indexing detent or biasing means can be provided for releasably locking the handle in its retracted or extended positions. In the case of a pivotal handle, this indexing means can be a cam-forming curvature on each hinge against which the shanks press by inherent resiliency. In the case of the shiftable handle, springs can bias the handle into the retracted position. The springs can surround the shanks of a handle.

BRIEF DESCRIPTION OF THE DRAWING

The above and other objects, features and advantages of the present invention will become more readily apparent from the following description, reference being made to the accompanying drawing in which:

FIG. 9 is a partial side view in highly diagrammatic form, illustrating an embodiment of the invention in which the handle is slidable;

FIG. 10 is a perspective view of this embodiment showing the handle in its retracted position; and FIGS. 11 and 12 are diagrams in the form of plan views representing the retracted and extended position of this embodiment, respectively.

SPECIFIC DESCRIPTION

The device of the present invention, in its first embodiment, comprises two handles 1 each having the shape of a stirrup and pivotally connected to a respective ski 2 of a pair of skis, substantially in the region of the center of gravity of an assembly.

Figure 1:
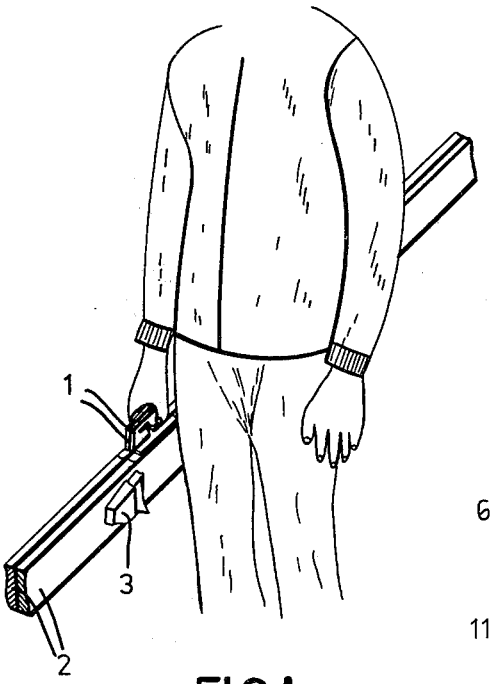
FIG. 1 is a fragmentary perspective view showing a pair of skis equipped with the devices of the present invention and being carried in one hand by a skier.

Each assembly comprises a ski 2, the handle arrangement and the ski bindings, part of which has been shown at 3 in FIG. 1. The device is thus located between the toe piece and the heel member of the ski binding. Each handle is pivotal about a respective axis 4 parallel to the longitudinal dimension of the ski 2 and along one of the sides thereof.

Figure 4:
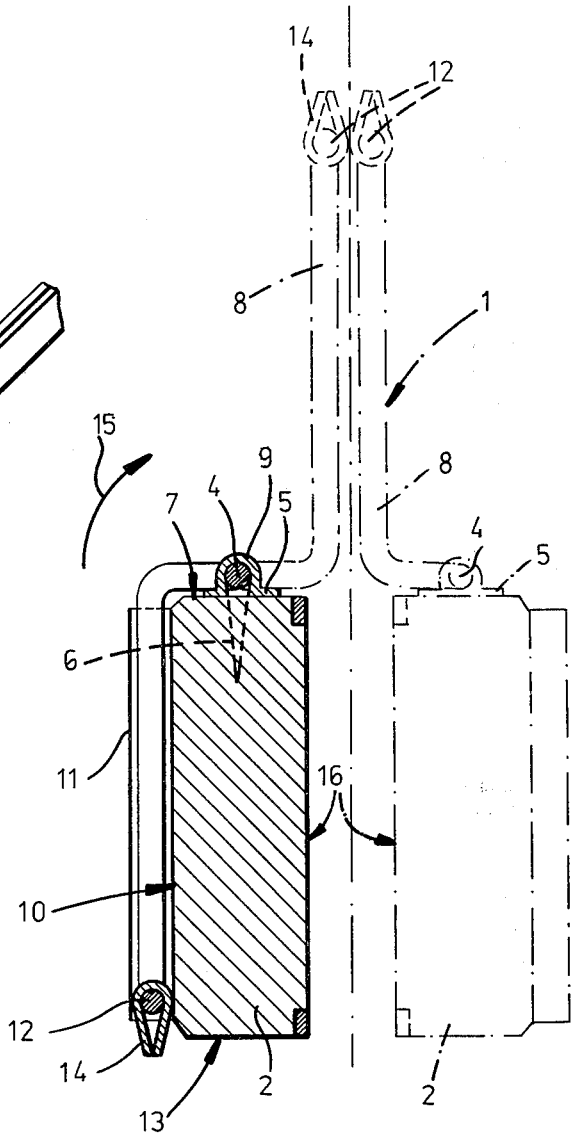
FIG. 4 is a transverse cross sectional view through the ski showing the handle in its retracted position but indicating in dot-dash lines the extended position as well as another ski of the pair with its handle in an extended position.
Figure 2:
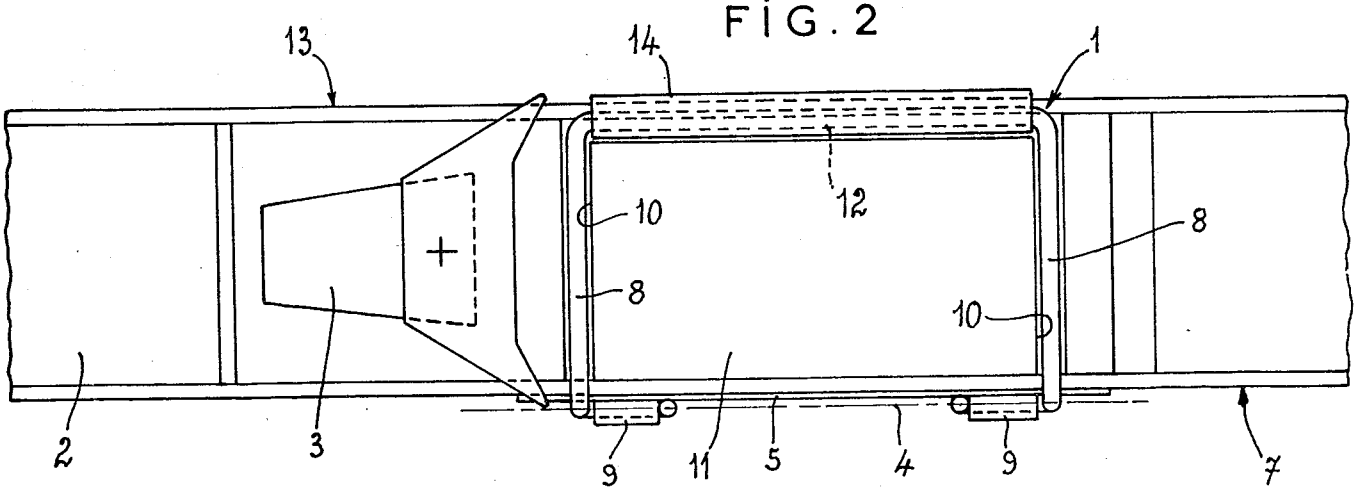
FIG. 2 is a partial top plan view of a ski provided with a handle of the pivotal type, according to one embodiment of the invention, the handle being shown in its retracted position.
Figure 3:
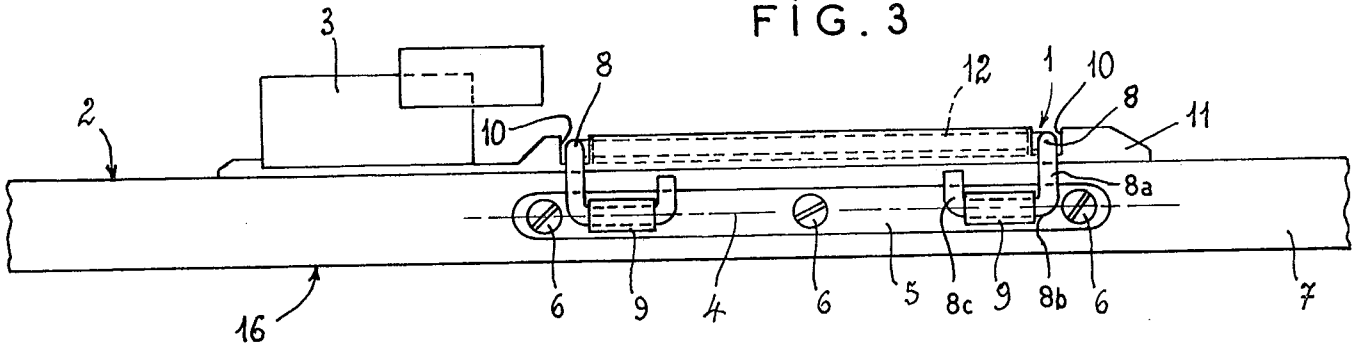
FIG. 3 is a side view corresponding to FIG. 2.

In the construction illustrated in FIGS. 2 through 4, the pivotal mounting of the handle is effected by an elongated hinge member 5 connected by screws 6 to one of the lateral flanks 7 of the ski.

Close to the free end of each shank 8 of the stirrup forming each handle, a downward bend is provided, followed by a bend toward the other shank and finally an upward bend, these bends being represented at 8*a*, 8*b* and 8*c* in FIG. 3. The resulting horizontal member formed by the bend 8*b* of each shank 8 is received in a sleeve or bent-over lug 9 of the hinge 5 to form a pintle defining a pivot axis 4.

When the handle 1 is in its retracted position (FIGS. 2 and 3) the two shanks 8 are received in and disposed below the tops of a pair of transverse grooves 10 formed in a plate 11 of synthetic resin material serving as a tread piece for the wall of the ski boot of the user directly adjacent the top clamp 3 of the ski binding.

The bight or intermediate portion 12 of the handle 1, i.e. the part between the two shanks 8, is located above the opposite flank 13 of the ski 2 (FIGS. 2 and 3) so as to be easily engaged by the hand of the user to enable the handle to be swung from the solid line position shown in FIG. 4 to the dot-dash position.

In the retracted position, therefore, the handle does not interfere with any of the normal ski maneuver. The intermediate region 12, moreover, may be provided with a grip sheath, e.g. of synthetic resin material or rubber, to prevent slipping of the handle in the hand of a user.

As shown in FIG. 4, the handle is pivoted through about 180° about its pivot axis 4 into its extended position as represented by the arrow 15. The handle thus lies practically in the plane of the bottom face 16 of the ski and a single ski can be readily transported in a balanced manner. If a second ski 2 of the pair is also to be carried, it is positioned as shown in broken lines in FIG. 4 in a mirror-symmetrical relationship so that the two bottom surfaces are juxtaposed and the bights 12 of the two handles are gripped in one hand by the user (FIG.1).

Figure 5:
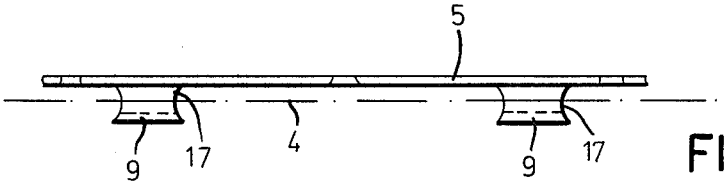
FIG. 5 is a plan view of a hinge assembly which can be utilized with the handle of FIGS. 1 through 4 for indexing this handle in its extended position.

FIG. 5 shows that the hinge 5 can have curved edges 17 at the sleeves 9. If the handle is a bent wire or rod mounted so as to bear against these curved edges by the inherent elasticity of the handle, this curvature can maintain the handle in its retracted position by camming action.

Figure 7:
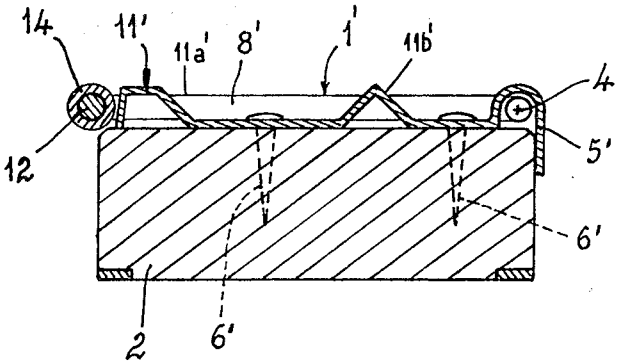
FIG. 7 is a section taken along the line VII—VII of FIG. 6.
Figure 8:
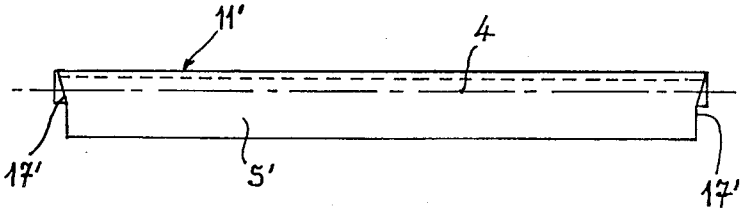
FIG. 8 is a side view in the direction of the arrow F of FIG. 6 of the tread plate which also forms a spring for a handle in accordance with the invention.
Figure 6:
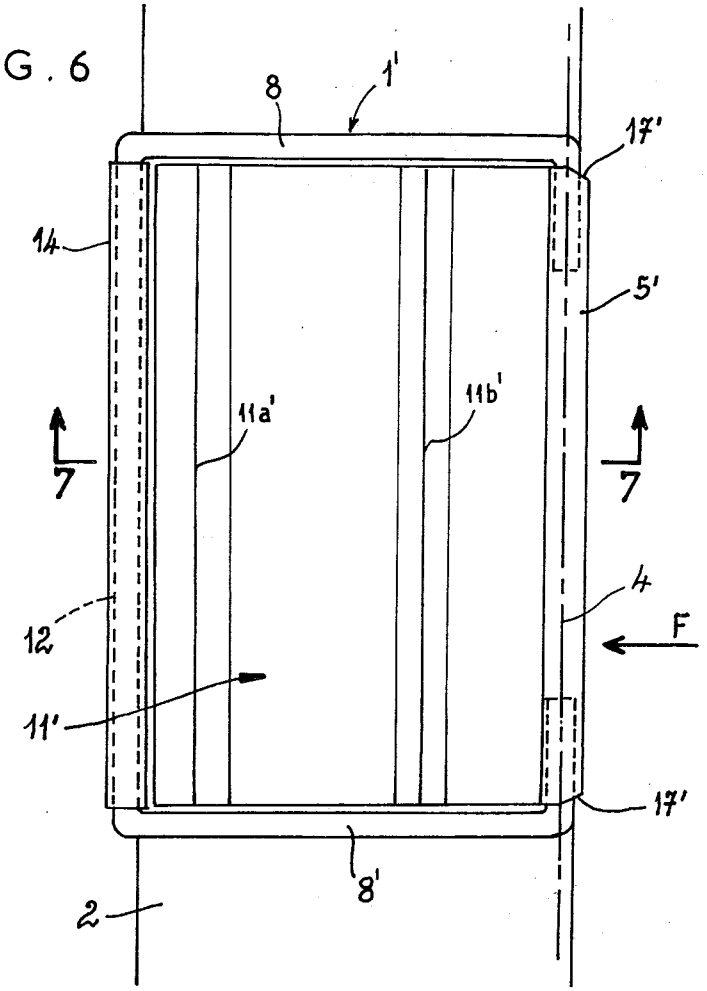
FIG. 6 is a top plan view similar to FIG. 2 illustrating a modification of this embodiment.

FIGS. 6 through 8 show a modification of this embodiment wherein the pivot axis 4 of the handle is not located on a lateral flank of the ski 2 but along an edge of the upper surface of the ski, this handle 1' being also stirrup-shaped and having its two shanks 8' bent to extend into a sleeve portion 5' connected to the ski. The sleeve portion 5' which defines the hinge is here formed unitary with a tread place 11' attached by screws 6' (FIG. 7) to the upper surface of the ski.

The hinge-forming part 5' of the place 11' has curved edges 17' adapted to ends of the handle in the extended position by the camming action previously described. In this embodiment the transverse grooves are not provided by longitudinal risers 11*a* and 11*b* extending along the tread plate which is flanked by the shanks 8' of the rail.

FIGS. 9 through 12 show another embodiment of the invention in which the ski carries a guide plate 18 provided with a handle 1'' having shanks 8''. These shanks are connected by a bight or intermediate portion 12 in the manner previously described and in this embodiment the handle is retracted and extended slidably rather than pivotably.

The two shanks 8'' are thus guided slidably in two parallel channels formed in the plate 18 fixed in the upper surface of the ski 2 between the toe piece and the heel piece 3 and 19, respectively, of the binding. The channels guide the handle for movement in the direction of arrow 20 (FIG. 10), i.e. parallel to the plane of the ski 2 and in a direction perpendicular to the longidutinal axis of the ski.

The handle 1 is thus movable between a retracted position (FIG. 11) in which most of the handle is received in the guide plate 18, and an extended position (FIG. 12) in which most of the handle extends laterally of this plate.

Two coil-type compression springs 21 are provided, each spring surrounding one of the shanks 8'' and being fitted against the free end thereof and against the plate 10 to urge the handle in the direction opposite arrow 20 into the retracted position.

The force of these springs should be such that the weight of the ski alone is able to bring about full compression of the spring and hence full extension of the handles but, when the handles are released, the springs can retract the handles fully.

The invention as described, of course, is amenable to modifications within the spirit and scope of the claims, for example, the one-piece hinge 5 can be replaced by two short hinge pieces, each engaging one of the shanks of the handle 1. The cam indexing means can be replaced by a spring or eccentric.

In addition, it may be noted that the hinges need not be applied as separate members but rather can constitute part of the ski binding or some other apparatus normally affixed to the surface of a ski, such as a ski brake. Practically any extension of such members may be employed for this purpose as long as they provide the longitudinal axis 4 for the handle 1 as previously described.

Finally, the invention is applicable not only to the downhill ski shown in the drawing but to skis of all types and for all purposes, the handle being applied upon manufacture of the skis, assembly of the skis with bindings, or as separate accessories for attachment to the skis.

I claim:

1. A ski assembly enabling individual carrying of a single ski or the carrying of a pair of skis by one hand of a user, said assembly comprising:

a ski having an upper surface provided with a binding and having a center of gravity;

a carrying handle; and means on said surface and forming part of the ski during skiing use thereof for movably mounting said handle on said ski in the region of said center of gravity whereby said handle is displaceable from a retracted position wherein said handle overlies said surface and is disposed below a ski boot, and an extended position wherein said handle projects outwardly beyond a longitudinal edge of said ski to enable carrying by a user, said handle being in the form of a stirrup having a pair of shank, said mounting means including means hinging said shanks on said surface to define a pivot axis for said handle parallel to the longitudinal dimension of the ski and along an edge thereof whereby said handle can swing through about 180° between said positions.

2. The assembly defined in claim 1, further comprising a tread plate on said surface of said ski formed with a pair of transverse grooves each receiving a respective one of said shanks.

3. The assembly defined in claim 1 wherein each of said shanks is provided with a bent free end engaged in a hinge fixed along a lateral flank of said ski.

4. The assembly defined in claim 1 wherein the means pivotally connecting said handle to said ski are extensions of said binding.

5. The assembly defined in claim 1 wherein said mounting means includes curved surfaces, said shanks elastically bearing upon said surfaces for releasably retaining said handle in one of said positions.

6. A ski assembly enabling individual carrying of a single ski or the carrying of a pair of skis by one hand of a user, said assembly comprising:

a ski having an upper surface provided with a binding and having a center of gravity;

a carrying handle; and means on said surface and forming part of the ski during skiing use thereof for movably mounting said handle on said ski in the region of said center of gravity whereby said handle is displaceable from a retracted position wherein said handle overlies said surface and is disposed below a ski boot, and an extended position wherein said handle projects outwardly beyond a longitudinal edge of said ski to enable carrying by a user, said handle having the configuration of a stirrup with two parallel shanks, said mounting means including a guide plate on said surface, said guide plate being formed with guide channels respectively receiving said shanks whereby said handle is displaceable between said positions in a direction perpendicular to the longitudinal axis of said ski and in a plane parallel to said surface.

7. The assembly defined in claim 6 wherein said shanks are each provided within said plate with a respective coil spring biasing said handle into said retracting position.

8. The assembly defined in claim 1, claim 2, claim 3, claim 4 or claim 6, further comprising means acting upon said handle for releasably retaining same in one of said positions.

* * * * *